US011198983B1

(12) United States Patent
Bennett

(10) Patent No.: US 11,198,983 B1
(45) Date of Patent: Dec. 14, 2021

(54) ARTIFICIAL SURFING REEF CONSTRUCTION METHOD

(71) Applicant: Walter Judson Bennett, Mechanicsville, VA (US)

(72) Inventor: Walter Judson Bennett, Mechanicsville, VA (US)

( * ) Notice: Subject to any disclaimer, the term of this patent is extended or adjusted under 35 U.S.C. 154(b) by 0 days.

(21) Appl. No.: 17/300,089

(22) Filed: Mar. 8, 2021

(51) Int. Cl.
*E04H 4/00* (2006.01)
*E02B 3/04* (2006.01)

(52) U.S. Cl.
CPC ..... *E02B 3/046* (2013.01)

(58) Field of Classification Search
CPC ..... E04H 3/16; E04H 4/0081; E02B 3/046; B65G 5/00
See application file for complete search history.

(56) References Cited

U.S. PATENT DOCUMENTS 3,024,470 A 3/1962 Baker
3,383,863 A * 5/1968 Berry ..... G01M 3/40 405/270
3,429,085 A * 2/1969 Stillman, Jr. ..... E04H 4/00 52/169.7
4,993,870 A * 2/1991 Bridgewater ..... E02B 3/126 405/15
5,056,960 A * 10/1991 Marienfeld ..... B09B 1/00 405/270
5,344,490 A 9/1994 Roosen
6,317,901 B1 * 11/2001 Corpuel ..... E04H 4/00 4/487
7,572,525 B2 8/2009 McDonald
9,049,819 B2 * 6/2015 Chang ..... E02D 17/20
9,187,902 B2 11/2015 Krasnoff et al.
9,739,068 B2 8/2017 Richards et al.
10,167,635 B2 1/2019 Krasnoff et al.
10,435,859 B2 10/2019 Krasnoff
10,751,910 B1 8/2020 Richards et al.
2008/0060123 A1 * 3/2008 Johnson ..... A63B 69/0093 4/491
2009/0151064 A1 * 6/2009 Mladick ..... E04H 4/0006 4/491
2010/0088814 A1 * 4/2010 Johnson ..... A63B 69/125 4/491
2010/0233417 A1 9/2010 Brewin et al.
2016/0009050 A1 1/2016 Crowel et al.
2018/0147469 A1 * 5/2018 Bennett ..... A63B 69/0093
2018/0245739 A1 * 8/2018 Vaughn ..... F17C 13/083

* cited by examiner

*Primary Examiner* — Benjamin F Fiorello

(57) ABSTRACT

The present invention relates to a new artificial surfing reef construction method, using geosynthetic cementitious composite mat, with a top coating of plasticized gypsum composition. The current invention artificial surfing reef construction method, can be built in surfing lakes, water basins, pools, lagoons, ponds, reservoirs, rivers, streams and bodies of water.

1 Claim, 2 Drawing Sheets

ARTIFICIAL SURFING REEF CONSTRUCTION METHOD

BACK GROUND OF THE INVENTION

The current construction method to build artificial surfing reefs for recreational surfing in surfing pools or lakes, has proven general suitable. However, there are inherent deficiencies with current construction methods. The traditional construction method to build an artificial reef for surfing is shaping and contouring dirt in the surf pool. Other kinds of construction methods are to use inflatable artificial surfing reefs, made out of PVC, Hypalon, Neoprene or other fabrics. Other methods for making artificial reefs are to stack and fill geomembrane bags full of sand. Forming with rebar and forms and pouring traditional concrete is also used to shape artificial surfing reefs in surf pools. The cost to build artificial surfing reefs under this construction method has been proven costly to developers and contractors. If the artificial surfing reefs are built by poured and formed concrete, then current construction methods of artificial surfing reefs, require a lot of construction preparation time and time to construct the rebar into place and then time to form the concrete. The concrete requires a lot of man hours to pour the concrete and use of a lot of construction equipment. Such as concrete pouring trucks, and man power to spread out and smooth out the concrete. The proposed solutions to improve construction methods to build artificial surfing reefs to date have been ineffective in providing a satisfactory remedy. Therefore, it's desirable to provide an artificial surfing reef construction method for contractors that are less costly and easier and less time consuming to construct.

Another construction method that wake board lakes and surf pools, surf lakes use, is laying down a lake liner to create a water proof membrane over top of the dirt shaped artificial surfing reef. The problem with this construction method is the lake liners tear and create a break in the water proof membrane and expose the artificial surfing reef. This creates costly down times and very high repair costs to repair the lake liner.

PRIOR ART

In US Patent Application Publication 20100233417 (Brewin & Crawford), discloses an impregnated concrete cloth or fabric specifically claimed to be used in forming a cover for prefabricated shelter, to form a track way for vehicles, pedestrians or animals, to form a shelter by applying the fabric to a framework, to make form work for casting concrete, to form barriers, line tunnels, to repair or reinforce structures, to form floors, damp proof structures, to reinforce earth structures, to provide flood defenses, to repair existing pipes, including buried water pipes or to construct new pipes, to fire proof elements of new or existing structures, to form a hard surface, reduce dust hazards, and contain fuel spills for aircraft, to reinforce sandbag structures, and protect them from ultraviolet degradation and damage from the elements, to line ground works, to form a waterproof lining for the containment of water, to form permeant awnings or roof structures, to form artistic or decorations forms and to form hulls and superstructures of floating vessels such as boats or pontoons. The current invention teaches away from (Brewin & Crawford), because claims directed to an apparatus must be distinguished from the prior art in terms of structure rather than function. The current invention uses Geosynthetic Cementitious Composite Mat (GCCMS), with distinguished structure to form an artificial surfing reef in a water basin. Brewin and Crawford teach away from using their impregnated concrete cloth or fabric to create artificial surfing reefs in a water basin or any body of water.

In U.S. Pat. No. 3,024,470 (Baker) shows a liner (22) of PVC cut to the size of a pool that has been laid with concrete (20) but fails to show the concrete as an impregnated concrete fabric or cloth and sprayed with a top coat of plastic gypsum spray to create a water proof membrane as in the current invention.

In U.S. Pat. No. 5,344,490A and U.S. patent Ser. No. 08/110,920 (Roosen), teaches of creating a plasticized gypsum composition. However, fails to teach of using plasticized gypsum composition over top impregnated concrete cloth to create an artificial surfing reef in a water basin or body of water to be used for recreational activities or surfing.

SUMMARY OF THE INVENTION

Method for providing a more efficient way to construct an artificial surfing reef in a body of water for surfing are disclosed. The benefits include a less costly way to construct and build an artificial surfing reef. The construction methods are more efficient, time saving and less consuming way to build an artificial surfing reef for recreational surfing.

The water basin body of water is first excavated, and the dirt removed from the water basin, by using excavation equipment and machines. The water basin is used as a surfing recreational body of water. The dirt on the bottom of the surf lake or surf pool is then shaped with different slopes and contours (Bathymetry), to create artificial surfing reefs, which create different surfing breaks. After shaping the bottom of the surf lake, the next step is to then create a way to shape and make the artificial surfing reefs in the surf lake. Just shaping the existing dirt into an artificial reef works, but over time the ground will settle and the artificial reef will eventually crumble and break apart. The settling or moisture in the dirt will break down the integrity of the artificial surfing reef shape over time. Therefore, you need a way to ensure that the artificial surfing reef will not break down over time and will remain a solid reef structure. The current invention has solved this problem and has improved the way artificial surfing reefs can be created in a surfing body of water.

A Geosynthetic Cementitious Composite Mat (GCCMS), is placed over top of the contoured sloped earth bottom (artificial surfing reef). The geosynthetic fabric is impregnated with Portland Cement and is then sprayed down with water and creates a hardened cementitious mat. The geosynthetic cementitious composite mat then creates a hardened shaped artificial reef structure used for creating surfing waves in the water basin. The geosynthetic cementitious composite mat is secured to the surfing water basin bottom by using a jpeg, earth anchors, soil nail, bullet anchor or an arrow anchor connected to a cable, which is secured by a round disc. The cable is then pulled through the round disc until tightened. The discs are placed over top and through the seams of the geosynthetic cementitious composite mat. The cable threads through the round disc and is pulled tight and the round disc secures the cementitious composite mat to the bottom of the surf lake. The anchors, cable and round disc anchoring method is put through the over lapping seams of the cementitious composite matt. J Pegs can also be used to secure the geosynthetic cementitious composite mat to the dirt shaped artificial surfing reef. The seams of the GCCM artificial reef are then water proof and sealed by spraying a coating of plasticized gypsum spray over the round discs and the over lapping seams. Once the geosynthetic cementitious composite mat is hydrated with water, the cement impregnated mat will be hardened to 5000 psi. Once this method and process is complete a long-lasting artificial surfing reef has been created in the surfing water basin. If any earth dirt underneath of the cement mat shall crumble or erode away, the hardened cement mat will still maintain its artificial reef shape integrity.

DETAILED DESCRIPTION OF DRAWINGS

FIG. 1

Figure 1:
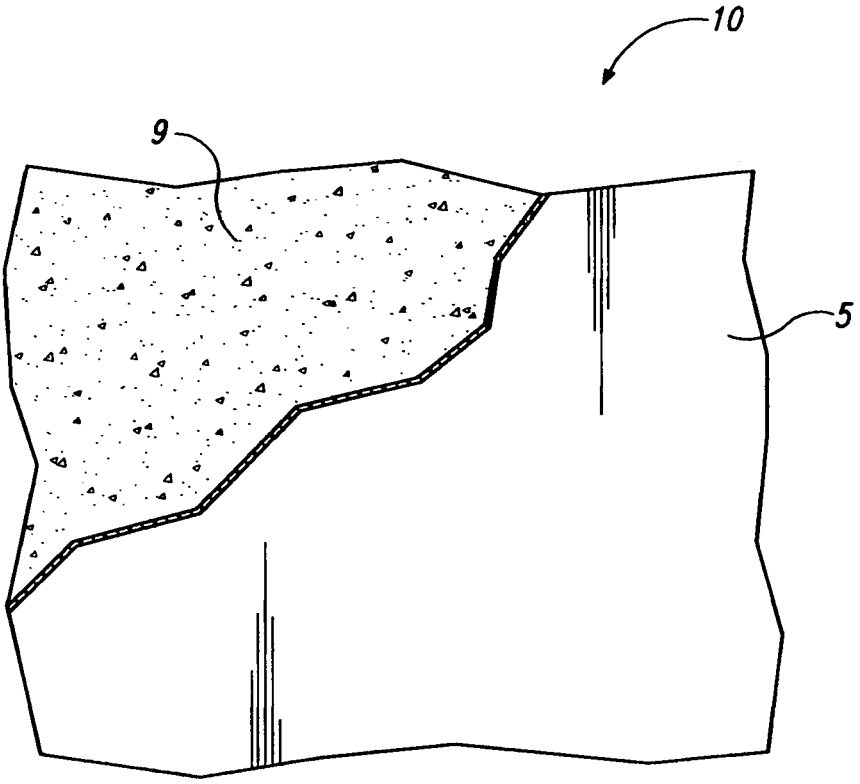
FIG. 1. is a top view of the invention.

FIG. 1 is a top-down view of the water basin construction method.

A geosynthetic cementitious composite mat 9 and, a coating of plasticized vegetable oil and common gypsum mixture 5 over top of a geosynthetic cementitious composite mat 9 to form a water proof membrane 10.

Figure 2:
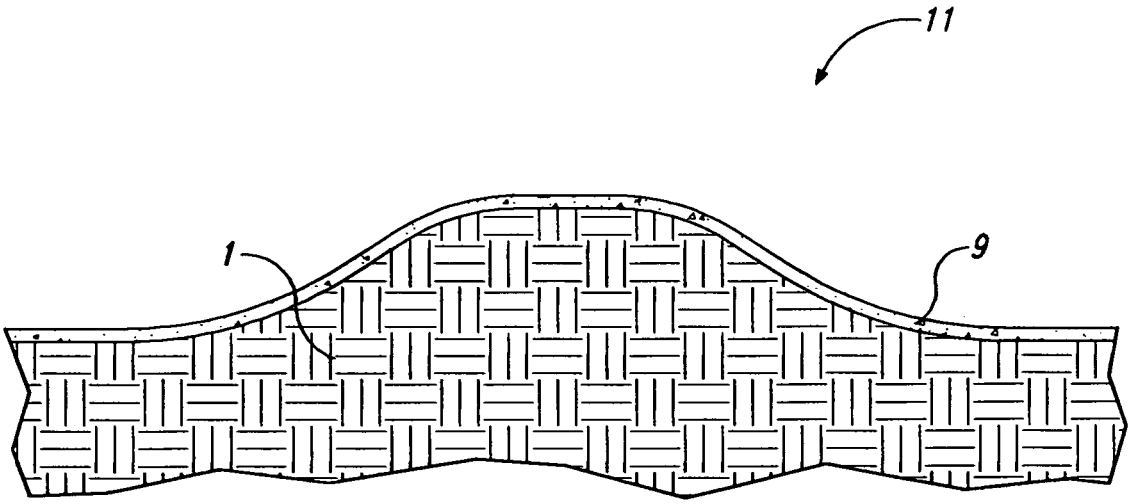
FIG. 2. is a section view of the invention.

FIG. 2:

FIG. 2 is a section view of each layer of the artificial surfing reef in the water basin.

A geosynthetic cementitious composite mat 9 laid over top of a contoured sloped water basin bottom 1 to form an artificial surfing reef 11.

FIG. 3.

Figure 3:
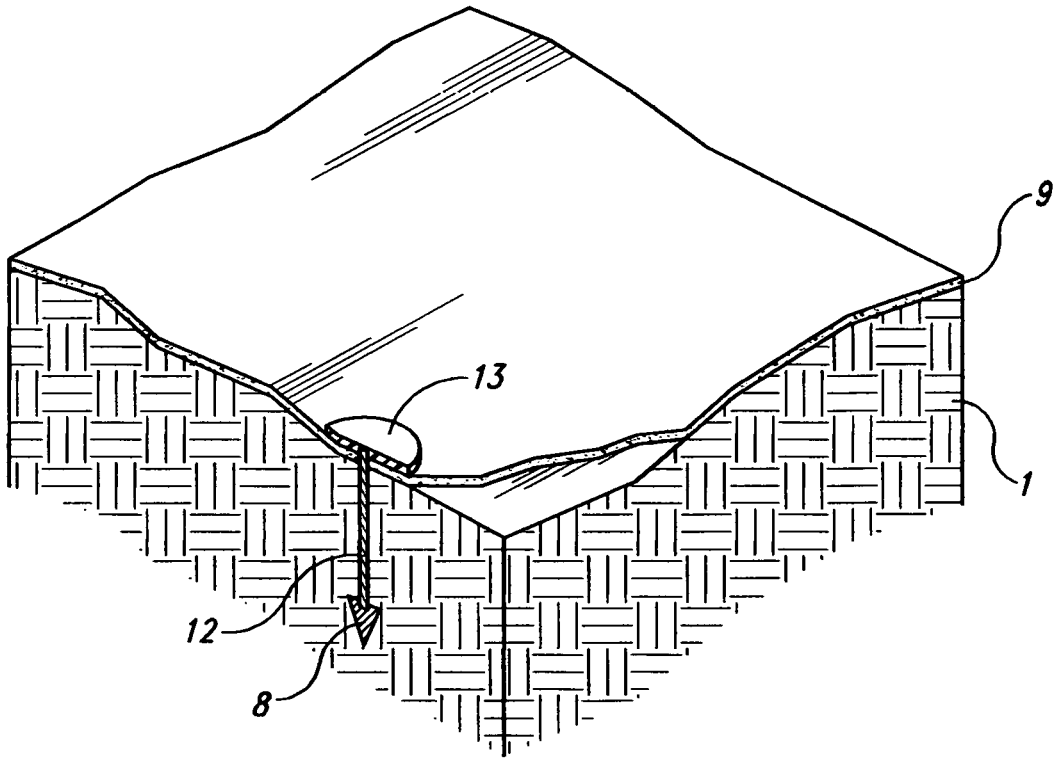
FIG. 3. is a top view of the invention.

FIG. 3 is a top view of the water basin construction method.

The geosynthetic cementitious composite mat 9 that is anchored to the water basin bottom 1 by an anchor 8, cable 12 and a round disc 13.

The invention claimed is:

1. A method for constructing an artificial surfing reef comprising:

shaping a water basin bottom to form a contoured sloped water basin bottom;

laying a plurality of geosynthetic cementitious composite mats over top of the contoured sloped water basin bottom; wherein the plurality of geosynthetic cementitious composite mats overlap creating overlapping seams;

applying a coating of plasticized gypsum composition over top of the geo synthetic cementitious composite mats in order to form the artificial surfing reef; and anchoring the geosynthetic cementitious composite mats to the contoured sloped water basin bottom with an anchor, a cable and a round disc by placing the anchor, the cable, and the round disc through the overlapping seams of the geosynthetic cementitious composite mats to secure the mats to the contoured sloped water basin bottom.

* * * * *